US009527698B2

(12) United States Patent
Hjort

(10) Patent No.: US 9,527,698 B2
(45) Date of Patent: Dec. 27, 2016

(54) COUPLING MEANS FOR ELECTRICALLY CONNECTING A HEAD-BLOCK TO A SPREADER IN A CONTAINER-LIFTING ARRANGEMENT

(71) Applicant: Dellner Components Sp.z.o.o, Gdynia (PL)

(72) Inventor: Mattias Hjort, Hedemora (SE)

(73) Assignee: DELLNER COMPONENTS SP. Z.O.O., Gdynia (PL)

( * ) Notice: Subject to any disclaimer, the term of this patent is extended or adjusted under 35 U.S.C. 154(b) by 0 days.

(21) Appl. No.: 14/762,867

(22) PCT Filed: Oct. 28, 2013

(86) PCT No.: PCT/EP2013/072489
§ 371 (c)(1),
(2) Date: Jul. 23, 2015

(87) PCT Pub. No.: WO2014/114374
PCT Pub. Date: Jul. 31, 2014

(65) Prior Publication Data

US 2015/0329332 A1 Nov. 19, 2015

(30) Foreign Application Priority Data

Jan. 24, 2013 (SE) ..... 1350076

(51) Int. Cl.
*H01R 13/44* (2006.01)
*B66C 1/10* (2006.01)
(Continued)

(52) U.S. Cl.
CPC ..... *B66C 1/101* (2013.01); *B66C 13/14* (2013.01); *H01R 13/629* (2013.01); *H01R 24/66* (2013.01); *H01R 24/76* (2013.01)

(58) Field of Classification Search
CPC ..... H01R 13/447; H01R 13/4534; H01R 13/4536; H01R 13/4532; H01R 13/4538
(Continued)

(56) References Cited

U.S. PATENT DOCUMENTS 2,579,538 A * 12/1951 Bierce ..... H01R 13/453 174/67
3,990,758 A * 11/1976 Petterson ..... H01R 13/4536 439/138
(Continued)

FOREIGN PATENT DOCUMENTS

WO 0069767 A1 11/2000
WO 2011078792 A1 6/2011

*Primary Examiner* — Thanh Tam Le
(74) *Attorney, Agent, or Firm* — Browdy and Neimark, PLLC

(57) ABSTRACT

A coupling unit for electrically connecting a head-block to a spreader in a container-lifting arrangement includes a plug member to be mated with a socket member. One of the plug and the socket members is supported on the head-block and the other one is supported on the spreader. Upon connection and disconnection, the plug and socket members are controllable in relative movement separate from the movement of the head-block relative to the spreader. One of the plug and socket members is associated with an actuator and guided for linear movement relative to the other one, whereas the other one of the plug and socket members is universally flexibly suspended.

22 Claims, 3 Drawing Sheets

(51) Int. Cl.

| | |
|---|---|
| ***H01R 24/76*** | (2011.01) |
| ***H01R 24/66*** | (2011.01) |
| ***H01R 13/629*** | (2006.01) |
| ***B66C 13/14*** | (2006.01) |

(58) Field of Classification Search
USPC ..... 439/136–141, 145
See application file for complete search history.

(56) References Cited

U.S. PATENT DOCUMENTS

| | | | | | |
|---|---|---|---|---|---|
| 5,277,602 | A * | 1/1994 | Yi | H01R 13/7036 | 439/138 |
| 5,551,884 | A * | 9/1996 | Burkhart, Sr. | H01R 13/20 | 439/140 |
| 6,332,781 | B1 * | 12/2001 | Ito | H01R 13/187 | 439/138 |
| 6,832,923 | B2 * | 12/2004 | Sasame | H01R 13/6485 | 439/137 |
| 6,863,538 | B2 * | 3/2005 | Mattern | B60D 1/62 | 439/140 |
| 6,935,873 | B2 * | 8/2005 | Funatsu | H01R 13/4532 | 439/137 |
| 7,416,423 | B2 * | 8/2008 | Chi | H01R 13/4538 | 361/731 |
| 8,968,014 | B2 * | 3/2015 | Russell | H01R 13/4536 | 439/137 |
| 9,004,930 | B2 * | 4/2015 | Gualino | H01R 13/2421 | 439/136 |

* cited by examiner

Fig. 3
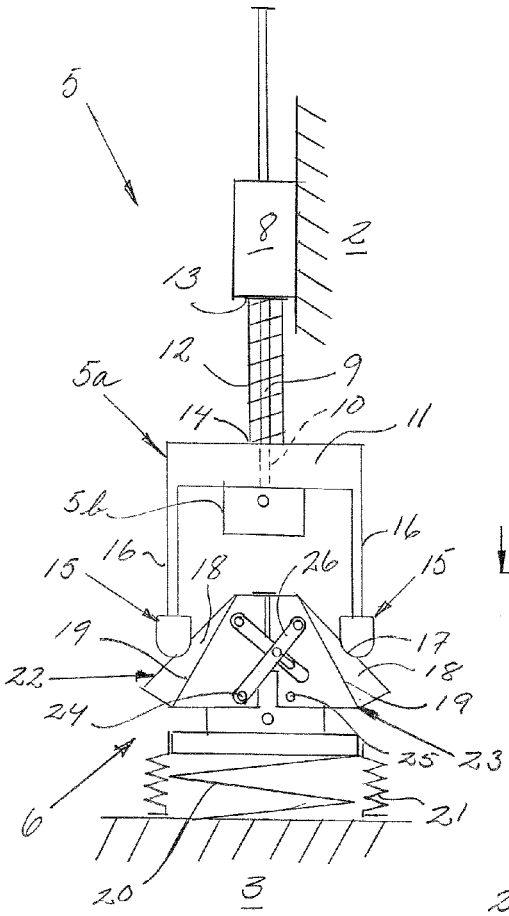
Fig. 4
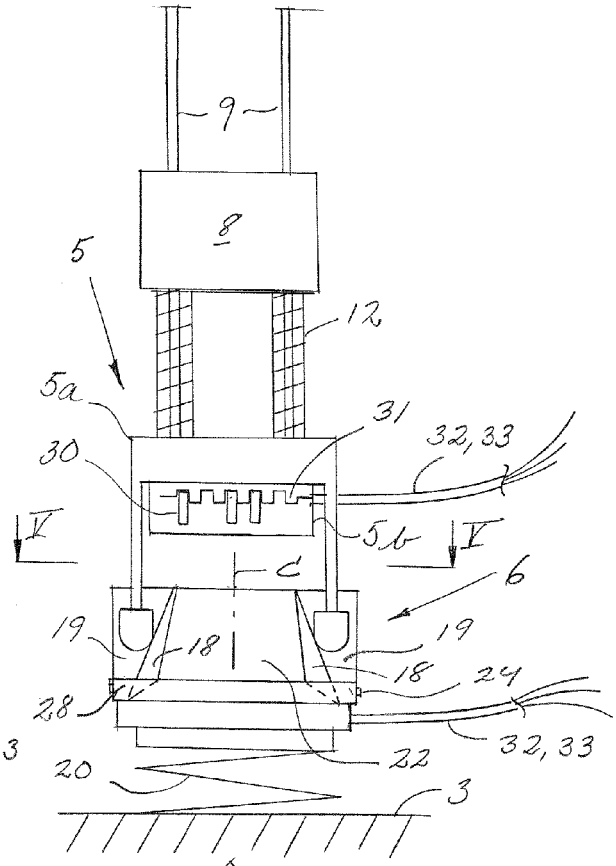
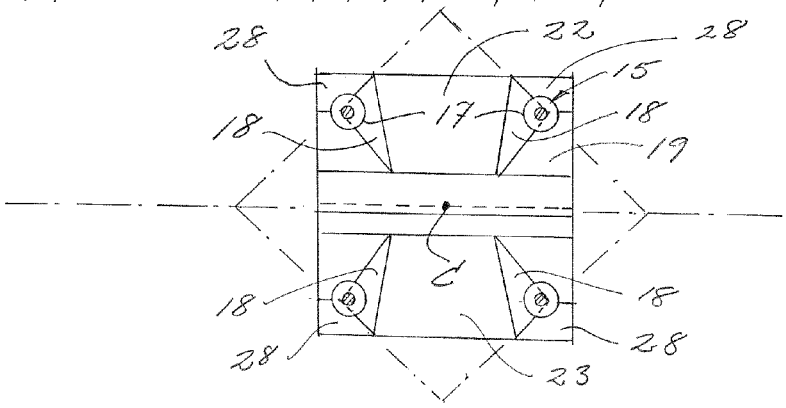
Fig. 5

21
9
13
12
5a
5b
23
15
28
29
4
22
27
24
3
20
10

COUPLING MEANS FOR ELECTRICALLY CONNECTING A HEAD-BLOCK TO A SPREADER IN A CONTAINER-LIFTING ARRANGEMENT

TECHNICAL FIELD

The present invention refers to a coupling means which is configured for electrically connecting a head-block to a spreader in a container-lifting arrangement.

BACKGROUND AND PRIOR ART

In container handling operations such as ship-to-shore movements, e.g., a crane-mounted lifting arrangement is typically used for moving a goods container from ship to shore or vice versa. The lifting arrangement typically comprises an upper structure that is suspended from the crane's lifting cables, the upper structure usually named a head-block. The lower side of the head-block is coupled to a lifting frame that is connectable to a container, the lifting frame usually named a spreader. Mechanical connection between the head-block and the spreader is typically accomplished by means of twistable locking pins, often of a design similar to the twist-locks that are typically used for connecting a spreader to a container by engaging corner fittings which are arranged in the upper four corners of the container.

In operation the spreader requires controlling, such as controlling with respect to twist-lock rotation and shifting between locked and unlocked positions; controlling with respect to extension and retraction of spreader beams to accommodate for containers of different lengths; controlling with respect to the lowering and raising movements of corner guides/flipper arms that aid the operator to align the spreader with a container to be engaged, e.g. These movements may be electrically powered and controlling them requires transfer of working power as well as control signals from the head-block to the spreader.

Electrical power and control signals are typically transferred between head-block and spreader via a disconnectable plug and socket coupling that is manually handled, requiring that an operator enters the lifting arrangement several feet above the ground. This manoeuvre may be hazardous, not the least as weather conditions often makes the metal structures slippery.

There is thus a need and desire for a coupling means configured for electrically connecting a head-block to a spreader in a container-lifting arrangement without requiring manual handling of the plug and socket coupling.

SUMMARY OF THE INVENTION

The present invention therefore aims at providing an automatic or remotely controlled coupling means for electrically connecting a head-block to a spreader in a container-lifting arrangement.

A problem encountered in the search for an automatic or remotely controlled electrical connection between head-block and spreader in a container-lifting arrangement is the necessity to compensate for unavoidable misalignment between head-block and spreader in their interconnected state. In practice, upon connection, the electrical coupling means should be able to accommodate for misalignment amounting to at least +/−20 mm horizontally and a tilt angle of at least 2° in all directions. In connected mode the coupling means shall provide uninterrupted electrical connection in spite of vertical movements between the head-block and the spreader in the order of 30 mm, which may occur during operation of the lifting arrangement.

Another problem that needs to be addressed is the necessity to protect the electrical contacts from contamination and harsh weather. Still another problem is the necessity to permit disconnection and separation of the coupling means also in a situation where electrical power is lost.

The above stated object is met in a coupling means comprising a plug member to be mated with a socket member, wherein one of the plug and the socket members is supported on the head-block and the other one is supported on the spreader, and wherein upon connection and disconnection the plug and socket members are controllable in relative movement separate from the movement of the head-block relative to the spreader, and further wherein one of the plug and socket members is associated with an actuator and guided for linear movement relative to the other one, whereas the other one of the plug and socket members is universally flexibly suspended.

As used in this context the expression universally flexibly suspended indicates a floating suspension that permits combined lateral movements and pivoting in all planes and directions, as well as elasticity causing a suspended member to return to a neutral position whenever unaffected by external forces.

It is preferred that the plug member is supported on the head-block and the socket member is supported on the spreader. It is likewise preferred that the plug member is the linearly movable member and the socket member is the universally flexibly suspended member.

In a preferred embodiment the socket member is suspended on the spreader and lifted so as to float in the end of a compression spring that rises from a structural member in the spreader to provide combined movements and pivoting in all planes and directions, as well as elasticity causing the socket member to take a neutral position when not affected by external force. In realization of this embodiment, one or several spring members may be arranged to provide distributed lifting force that balances the socket member in a neutral position wherein guide means on the plug and socket members are coarsely aligned to ensure engagement as the plug member is actuated in movement towards the socket member. In order to ensure necessary counter support for insertion of the plug member in the socket member, the spring(s) that support the socket member is dimensioned to have a maximum length of compression which is shorter than the operable length of linear actuation of the plug member. The spring member(s) can be realized as, e.g., coil metal springs, as pneumatic springs or rubber buffer springs etc., or may have the form of a flexible bellows that connects to the periphery of the socket member.

In order to facilitate mating of the plug and socket members without manual operation, the plug member and the socket member each comprises guide means respectively which in cooperation effect alignment of the socket member with the plug member as the plug member is actuated in movement towards the socket member to be mated therewith.

In one embodiment the guide means on the plug member comprises a pusher which is configured to engage a slanting guide face that is formed on the socket member.

The slanting guide face may be formed on a hatch which is pivotally journalled to the socket member and swung open by the pusher. In a non-mating and disconnected condition of the plug and socket members, the closed hatch covers a connection interface in the socket member.

The hatch may comprise two hatch sections which are journalled to swing open in mutually opposite directions as each hatch section is engaged by a pair of pushers, respectively, in the mating operation. Each hatch section is then formed on its exterior with two guide faces running at divergent directions, each guide face interacting with a pusher respectively, projecting from the plug member.

The hatch sections may further and advantageously be interconnected through a linkage that synchronizes the pivoting motions of the hatch sections. The interconnecting linkage may be configured to control the hatch sections to swing in consecutive order, this way facilitating an overlapping relation between the hatch sections in the closed state. The hatch sections may further be spring biased towards the closed state.

It is preferred that electrical connection is accomplished via a modular connection interface that is composed of contact modules which are optionally installable in the plug member and in the socket member. In each case, at least one contact module is configured for transmission of control signals and at least one contact module is configured for transmission of working power between the head-block and the spreader. To this purpose, the plug and socket members each comprises a contact module mounting base in which a contact module is installable under optional electrical contact with a control power bus or with a working power bus, respectively, running through the mounting base.

In a preferred realization of the invention the plug member comprises a positioning sub-member carrying guide means that provide alignment with the socket member, and a connecting sub-member carrying contacts providing electrical connection with the socket member. The connecting sub-member is journalled in the positioning sub-member for parallel linear motion in relation thereto, whereas the positioning sub-member is journalled in the head-block and guided for linear motion in relation to the head-block.

In the above realization of the invention, the connecting sub-member is acted upon by an actuator that operates the connecting sub-member in forward and return linear motion via a push/pull rod that is anchored in the connecting sub-member. The embodiment comprises a push/pull rod having one end fixedly anchored in the connecting sub-member and a rod section passing through the positioning sub-member. In forward motion, the positioning sub-member is operated via one or more compressible spring(s) that link the positioning sub-member to the connecting sub-member and thus transfers the motion of the push/pull rod and connecting sub-member to the positioning sub-member. Further extension of the connecting sub-member relative to the positioning sub-member in the forward direction thus requires loading of the spring(s) into a compressed state. In reversed direction, the positioning sub-member is brought into the return motion of the connecting sub-member in effect of physical contact between the two sub-members.

From the above it will be understood that the coupling means in each embodiment is structured to provide electrical connection between head-block and spreader in a two-step procedure, wherein in a first step the positioning and connecting sub-members of the plug member are jointly actuated to engage and to force the socket member into alignment with the plug member, and wherein in a second step the connecting sub-member is separately actuated to move relative to the positioning sub-member into electrical contact with the socket member.

SHORT DESCRIPTION OF THE DRAWINGS

Embodiments of the invention will be further explained below with reference made to the accompanying, schematic drawings, wherein FIG. 1 is a side view showing a head-block coupled to a spreader in a container-lifting arrangement;

FIG. 3 is an end view showing the coupling means in disconnected state and in position ready for mating a plug member with a socket member;

FIG. 4 is a side view of the coupling means of FIG. 3;

FIG. 5 is a top view of the socket member viewed from the sectional plane V-V through the coupling means of FIG. 4;

DETAILED DESCRIPTION OF PREFERRED EMBODIMENTS

Figure 1:
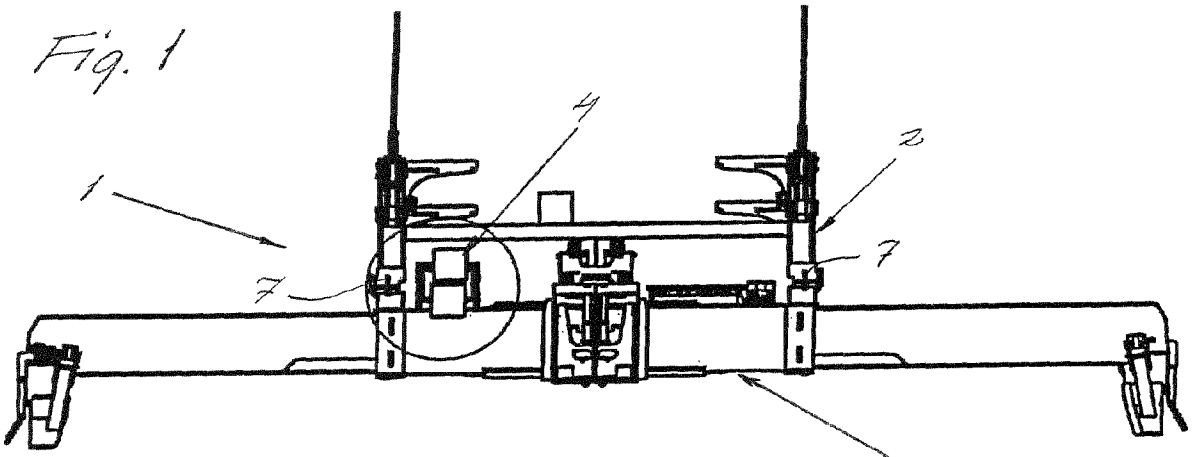
Figure 2:
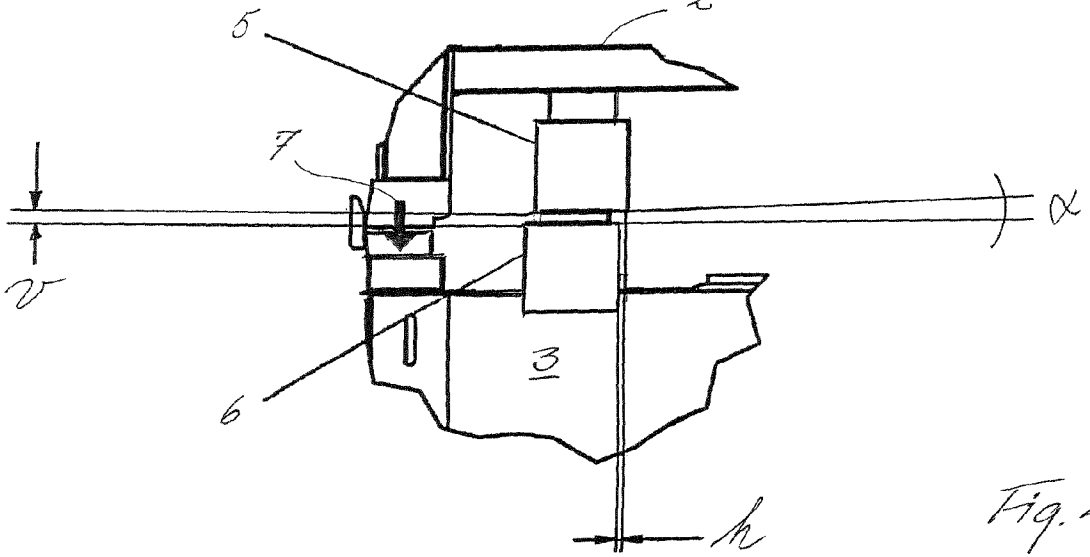
FIG. 2 is a cut out portion of the lifting arrangement in FIG. 1, showing on a larger scale the arrangement of a coupling means configured for electrically connecting the head-block with the spreader.

A container lifting arrangement 1 is schematically shown in FIG. 1, the lifting arrangement comprising a head-block 2 coupled to a spreader 3. A coupling means 4 is arranged on the lifting arrangement and configured for electrically connecting the head-block to the spreader. With reference also to FIG. 2, the coupling means comprises a plug member 5 to be mated with a socket member 6, the plug and socket members in a connected state permitting transfer of electrical power and control signals between the head-block 2 and the spreader 3. In the illustrated embodiment, the plug member is supported on the head-block structure and the socket member is suspended from the spreader structure, as will be described more in detail below. However, in alternative embodiments the head-block may carry the socket member whereas the plug member is instead supported on the spreader.

Upon docketing the head-block 2 with the spreader 3, as well as in their connected state and during operation, the relative position between the two structures may change in result of necessary allowances in coupling means 7, typically twist-locks 7, that connect the spreader to the head-block. This misalignment includes both horizontal and vertical displacement as well as tilting. In order to compensate for misalignment between head-block and spreader in operation and upon docketing, the coupling means 4 is designed to accommodate for displacement h in any horizontal direction amounting to at least 20 mm, to accommodate for vertical movements v of at least 30 mm, and to accommodate for a tilt angle a of at least 2° in all directions.

FIGS. 3, 4 and 5 illustrate the coupling means 4 in disconnected state. The plug member 5 is associated with an actuator 8 which is controllable for guided movement of the plug member in linear motion relative to the head-block 2, and thus also in relation to the socket member 6 which is suspended from the spreader 3, connected to the head-block 2. The actuator 8 may comprise any suitable drive means which is electrically, pneumatically or hydraulically operated. In the subject context it is preferred that the actuator 8 is electrically powered, and a 24 V DC-motor may be utilized in the actuator 8. The actuator 8 controls the movements of the plug member 5 by means of a push/pull rod 9, one end of which is anchored in the plug member 5.

More precisely, the push/pull rod 9 runs, via a guiding passage 10 through a joining section 11 that forms part of a positioning sub-member 5*a*, to another sub-member 5*b* which forms a connecting part of the plug member 5. The push/pull rod 9 runs inside a compression spring 12 which has an upper end 13 that is secured to the push/pull rod 9, and a lower end 14 which abuts the joining section 11 on the positioning sub-member 5*a*. The spring 12 is dimensioned to hold the connecting sub-member 5*b* into physical contact with the positioning sub-member 5*a* in all dis-connected states of the coupling means 4. The spring 12 has a compressible length sufficient to permit the necessary extension of the connecting sub-member 5*b* relative to the positioning sub-member 5*a* in the connected state.

Plug member 5 further comprises guide means 15 which is arranged for interaction with guide means formed on the socket member, as will be explained further below. The guide means 15 is arranged distributed about a vertical center C of the plug member. In the illustrated embodiment the guide means 15 is realized as four rounded bodies 15 arranged in the ends of legs 16 that project downwards from the joining section 11 of the positioning sub-member 5*a*. The guide means 15 comprises spherical or semi-spherical slide faces 17 and acts like a pusher which interacts with guide faces 18, 19 of inclined orientation on the socket member to force the socket member into alignment as the plug member is lowered for mating with the socket member. In this context the legs 16 may be seen as push rods although alternative designs are possible. For example, in alternative design, rounded, beveled, spherical or semi-spherical slide faces may be arranged in end regions of vertically extended corner portions of a generally box-shaped positioning sub-member.

The socket member 6 is suspended floating in the upper end of a compressible spring member 20 that rises from the spreader 3. In the embodiments depicted in the drawings the spring member 20 is only symbolically illustrated. Although shown as a singular spring member, a set of springs may alternatively be arranged and distributed under the socket member in order to provide, in all cases, a suspension by which the socket member 6 is balanced to take a neutral position when it is not subjected to external force. In alternative to conventional metal springs or pneumatic springs, e.g., or in combination therewith, a rubber bellows 21 may be arranged about the periphery of the socket member 6 to add stability and protection, or to serve as the major suspension.

Figures 6, 7, 8:
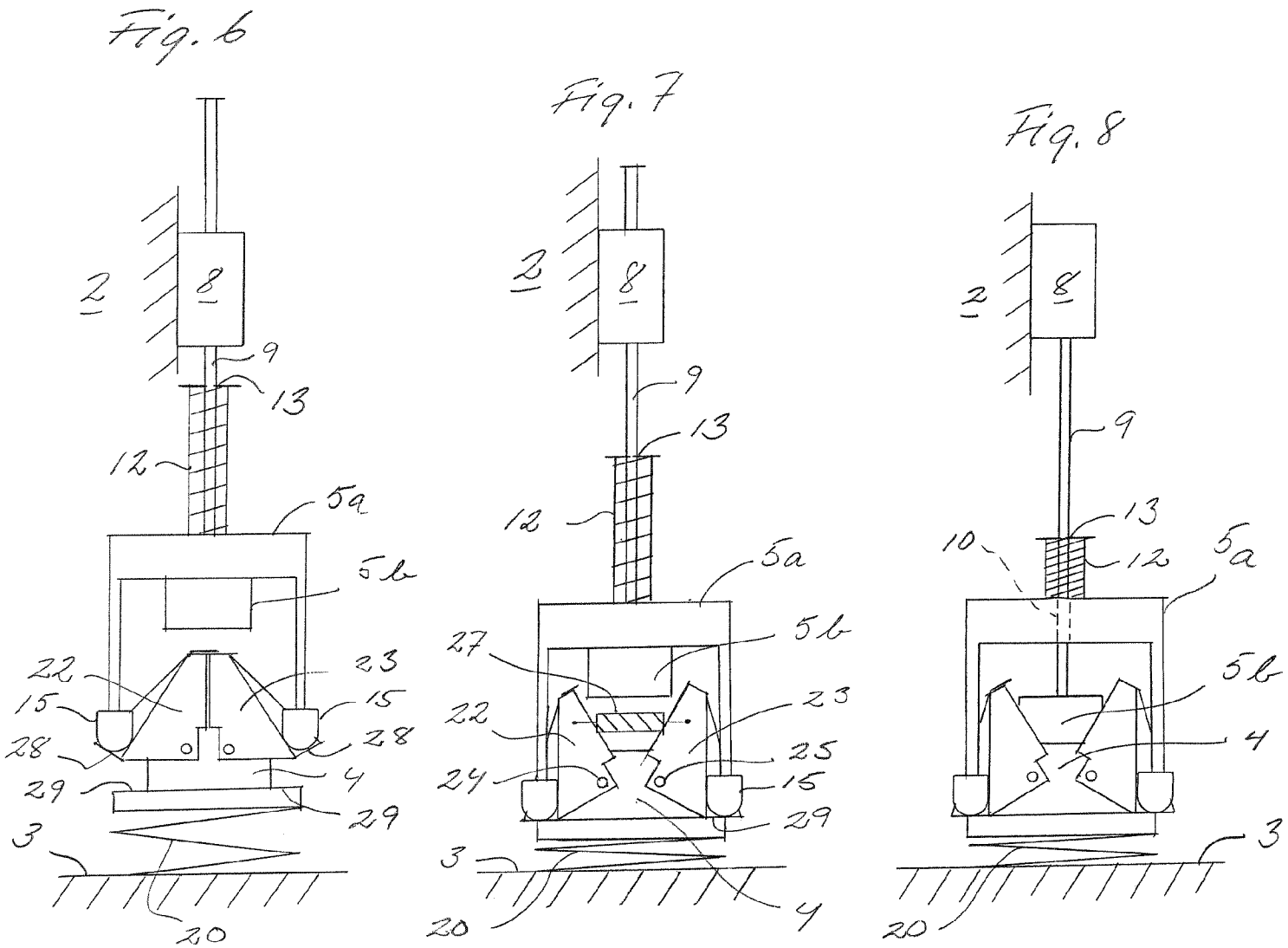
FIG. 6 is an end view corresponding to FIG. 3 and showing the coupling means in a state of alignment of the plug and socket members.
FIG. 7 is a corresponding end view showing the coupling means in a state of opening of the socket member to facilitate mating with plug member.
FIG. 8 is a corresponding end view showing the coupling means in connected state.

In disconnected state the socket member 6 is closed and covered under hatches 22 and 23. The hatches 22 and 23 are pivotally journalled to the socket member 6 on pivots 24, 25 and movable to swing open in opposite directions as the plug member is lowered for mating with the socket member, as illustrated in FIGS. 7 and 8. The hatches 22 and 23 meet above the center of the socket member, in an overlapping condition as illustrated through the dashed line going through the center C in FIG. 5. The overlapping closure of the hatches requires that the hatches are moving in consecutive order. To this purpose, the hatches are mechanically interconnected through a linkage 26 that controls the hatches to move one after the other in opening movement driven by the plug member/actuator 8, as well as in reversed order in the closing movement driven by a spring 27, see FIG. 7, which applies a bias that urges the hatches towards the closed state.

On opposite inclined side faces 19 of the hatches 22 and 23 respectively, slanting guide faces 18 are arranged at an angle relative to the appertaining side faces 19. The guide faces 18 are oriented to be engaged by the pushers 15 when the plug member is lowered for mating with the socket member as illustrated in FIG. 6. The guide faces 18 may be symmetrically oriented with respect to the vertical center C of the coupling means. In this respect, the guide faces 18 may be regarded as areas which are cut out from the sides of a pyramid that is turned 45° relative to the socket member, as illustrated through dash-dot lines in FIG. 5. In result of the pushers 15 sliding down along the guide faces 18 and adjacent side faces 19, the universally flexibly suspended socket member 6 will be forced into alignment with the plug member 5. The aligned condition is illustrated in FIG. 6 which also illustrates how the pushers 15 are received in a respective seat or pocket 28 which defines the aligned condition wherein the geometrical centers of the plug and socket members coincide.

In FIG. 7 the plug member 5 is further lowered by operation of the actuator 8. In result of the pushers 15 being arrested in the pockets 28, the hatches 22, 23 are swung open to a stop 29 defined on the socket member 6. From this opening state, further lowering of the plug member 5 results in compression of the suspension spring 20 until the spring force of that spring overcomes the force of the spring member 12. Further extension of the push/pull rod 9 will cause separation of the positioning and connecting sub-members 5*a*, 5*b* under compression of the spring 12, followed by insertion of the connecting sub-member 5*b* in the socket member 6 this way effecting the electrical connection of the head-block 2 with the spreader 3. Dis-connection is effected by operating the actuator 8 in the reversed order and direction.

As will be understood from the aforesaid, the plug and socket members 4 and 5 stay mutually coupled in effect of the balancing elastic force which is applied from the spring 20 in compressed state. This way it is ensured that electrical contact is maintained in spite of possible vertical displacements between head-block and spreader which may occur during operation of the container lifting arrangement. The spring characteristics and dimension of the spring 20 is chosen to accommodate for vertical movements in the order of at least 30 mm without affecting the connection between the plug and socket members. Also, since there is no mechanical or electro-mechanical coupling to hold the connecting members in connected state, dis-connection can be accomplished also in a powerless mode wherein actuator 8 is out of operation, simply by separating the head-block from the spreader and tearing the connecting members apart.

As used herein, the expression plug member is intended to describe a connecting member carrying a set of male contact elements, and the expression socket member is intended to describe a connecting member containing a set of female contact elements. In both cases, see FIG. 4, the contact elements may be grouped and arranged in contact modules 30 which are optionally installable in a contact module mounting base 31 for electrical contact with a control or signal power bus 32 or with a working power bus 33 running through the contact module mounting bases of the plug and socket members, respectively. This way, a connection interface may in each case be customized to fit the subject application.

Whereas the present invention is described above in terms of a schematically illustrated embodiment a skilled person will still realize that the written specification and appended claims cover also other embodiments that differ from the illustrated one with respect to the structure and design of details, without deviating from the scope of the invention as presented in the appended claims.

The invention claimed is:

1. A coupling means (4) for electrically connecting a head-block (2) to a spreader (3) in a container-lifting arrangement, wherein the head-block and the spreader are configured to be selectively engaged with one another during a container-lifting operation, the coupling means comprising:

a socket member (6), a plug member (5; 5*a*,5*b*) to be mated with the socket member (6), one of the plug member and the socket member being supported on the head-block and the other one of the plug member and the socket member being supported on the spreader, an actuator (8) operably connected to one of the plug member and the socket member, the one of the plug member and the socket member to which the actuator is connected being guided for linear movement relative to the other one of the plug member and the socket member, and a suspension device that universally flexibly suspends the other one of the plug member and the socket member that is not operably connected to the actuator, wherein upon connection and disconnection, the plug member and the socket member are controllable in relative movement separate from movement of the head-block relative to the spreader.

2. The coupling means of claim 1, wherein the plug member (5; 5*a*,5*b*) is supported on the head-block and the socket member (6) is supported on the spreader.

3. The coupling means of claim 2, wherein the plug member (5; 5*a*,5*b*) is operably connected to the actuator and the socket member (6) is suspended by the suspension device.

4. The coupling means of claim 3, wherein the plug member (5; 5*a*,5*b*) and the socket member (6) each comprises a guide device (15; 18,19) that cooperate with one another to effect alignment of the socket member with the plug member, as the plug member is actuated in movement towards the socket member for mating therewith.

5. The coupling means of claim 4, wherein the guide device on the plug member comprises a pusher (15) and the guide device on the socket member comprises a slanting guide face (18; 19), wherein the pusher (15) is configured to engage the slanting guide face (18; 19) as the plug member is moved towards the socket member.

6. The coupling means of claim 5, further comprising a hatch (22; 23) on which the slanting guide face (18; 19) is defined, the hatch being pivotally journaled to the socket member (6) and swung open by the pusher (15) and configured to cover a connection interface in the socket member in a non-mating, disconnected condition.

7. The coupling means of claim 6, wherein the hatch (22; 23) comprises two hatch sections pivoting in mutually opposite directions in opening and closing movements.

8. The coupling means of claim 7, further comprising an interconnecting linkage (26) that interconnect the hatch sections (22; 23) and configured to synchronize the pivoting motions of the hatch sections.

9. The coupling means of claim 8, wherein the interconnecting linkage (26) controls the hatch sections to swing in consecutive order.

10. The coupling means of claim 8, wherein the hatch sections are spring biased (27) towards a closed state.

11. The coupling means of claim 8, further comprising guide faces defined on an exterior of each hatch section (22; 23) running at divergent directions, each guide face interacting with the pusher (15) respectively, projecting from the plug member (5*a*).

12. The coupling means of claim 1, further comprising a modular connection interface comprising contact modules to be installed in the plug member or in the socket member to form an electrical connection.

13. The coupling means of claim 12, further comprising at least one contact module (30) configured to transmit control signals and working power between the head-block and the spreader.

14. The coupling means of claim 13, wherein the plug member and the socket member each comprise a mounting base (31) in which the at least one contact module (30) is to be installed under optional electrical contact with a control signal bus (32) or with a working power bus (33), respectively, running through the mounting base.

15. The coupling means of claim 3, wherein the socket member (6) is suspended floating relative to the spreader, and the suspension device comprises at least one compression spring connected to one end of the socket member and at another end to the spreader to provide combined movements and pivoting in all planes and directions, as well as elasticity causing the suspended socket member (6) to return to a neutral position when unaffected by external force.

16. The coupling means of claim 15, wherein the at least one compression spring has a compressible length that is shorter than an operable length of linear actuation of the plug member (5; 5*a*,5*b*).

17. The coupling means of claim 16, wherein the plug member comprises a positioning sub-member (5*a*) carrying the guide device (15) providing alignment with the socket member (6), and a connecting sub-member (5*b*) carrying contacts (30) providing electrical connection with the socket member (6).

18. The coupling means of claim 17, wherein the connecting sub-member (5*b*) is journaled in the positioning sub-member (5*a*) for parallel linear motion in relation thereto, and the positioning sub-member (5*a*) is journaled in the head-block (2) and guided for linear movement in relation thereto.

19. The coupling means of claim 18, wherein the connecting sub-member (5*b*) is acted upon by the actuator (8) that operates the connecting sub-member (5*b*) in forward and return linear motion.

20. The coupling means of claim 19, further comprising a push and pull rod (9) connected at one end to the actuator, passing through the positioning sub-member (5*a*) and anchored in the connecting sub-member (5*b*) to control motion of the plug member (5).

21. The coupling means of claim 19, further comprising at least one compressible spring (12) linking the positioning sub-member (5*a*) to the connecting sub-member (5*b*) to bring the positioning sub-member into a forward motion of the connecting sub-member, wherein relative forward motion between the positioning and connecting sub-members requires loading of the at least one compressible spring (12) into a compressed state.

22. The coupling means of claim 21, wherein the coupling means is structured to provide electrical connection between the head-block (2) and the spreader (3) in a two-step procedure, wherein in a first step the positioning and connecting sub-members (5*a*,5*b*) of the plug member are jointly actuated to engage and to force the socket member (6) into alignment with the plug member, and wherein in a second step the connecting sub-member (5*b*) is separately actuated to move relative to the positioning sub-member (5*a*) into electrical contact with the socket member (6).

* * * * *